US009679531B2

(12) United States Patent
Chen et al.

(10) Patent No.: US 9,679,531 B2
(45) Date of Patent: Jun. 13, 2017

(54) CORRECTING METHOD, CORRECTING APPARATUS AND METHOD FOR ESTABLISHING COLOR PERFORMANCE DATABASE FOR DISPLAY APPARATUS

(71) Applicant: MStar Semiconductor, Inc., Hsinchu Hsien (TW)

(72) Inventors: Chuan-Tsung Chen, Taoyuan (TW); Tien-Hua Yu, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 225 days.

(21) Appl. No.: 14/681,319

(22) Filed: Apr. 8, 2015

(65) Prior Publication Data

US 2015/0294643 A1 Oct. 15, 2015

(30) Foreign Application Priority Data

Apr. 9, 2014 (TW) ..... 103112944 A

(51) Int. Cl.

*G09G 5/06* (2006.01)
*G09G 5/02* (2006.01)
*G09G 3/00* (2006.01)

(52) U.S. Cl.

CPC ..... *G09G 5/026* (2013.01); *G09G 3/006* (2013.01); *G09G 5/06* (2013.01); *G09G 2340/06* (2013.01)

(58) Field of Classification Search

None

See application file for complete search history.

(56) References Cited

U.S. PATENT DOCUMENTS

2002/0135597 A1* 9/2002 Kagawa ..... G09G 5/02 345/600
2003/0072016 A1* 4/2003 Dalrymple ..... G06K 15/02 358/1.9
2006/0017742 A1* 1/2006 Hsu ..... G06F 3/04845 345/589

(Continued)

FOREIGN PATENT DOCUMENTS

TW 200538839 12/2005

OTHER PUBLICATIONS

Taiwan Patent Office, "Office Action," Sep. 17, 2015.

*Primary Examiner* — Barry Drennan
*Assistant Examiner* — Jason Pringle-Parker
(74) *Attorney, Agent, or Firm* — WPAT, PC; Justin King; Douglas Hosack

(57) ABSTRACT

A correcting method for a display apparatus is provided. For N original grayscale combinations, color performances of the display apparatus are respectively measured to generate N measurement results. A set of color blending equations are utilized for M original grayscale combinations according to the N measurement results to generate M blended results. From the N measurement results and the M blended results, P color performances respectively most approximate to P target performances are identified. The P target color performances correspond to P target grayscale combinations. The P color performances correspond to P original grayscale combinations in the (N+M) original grayscale combinations. A look-up table for correcting the display apparatus is established according to the P target grayscale combinations and the P corresponding original grayscale combinations.

8 Claims, 2 Drawing Sheets

(56) References Cited

U.S. PATENT DOCUMENTS

| | | | | |
|---|---|---|---|---|
| 2006/0238551 | A1* | 10/2006 | Dalal | G09G 3/002 345/690 |
| 2008/0089572 | A1* | 4/2008 | Yamano | A61B 6/461 382/131 |
| 2008/0180375 | A1* | 7/2008 | Wang | G09G 3/3611 345/89 |
| 2008/0208967 | A1* | 8/2008 | Hilliard | G06F 3/14 709/203 |
| 2008/0225055 | A1* | 9/2008 | Yu | G09G 3/2003 345/600 |
| 2011/0037379 | A1* | 2/2011 | Lecamp | H01L 51/5265 313/503 |
| 2011/0149166 | A1* | 6/2011 | Botzas | H04N 5/202 348/649 |
| 2011/0227941 | A1* | 9/2011 | Huang | H04N 1/6027 345/596 |
| 2014/0267470 | A1* | 9/2014 | Kang | G09G 3/2003 345/694 |

* cited by examiner

CORRECTING METHOD, CORRECTING APPARATUS AND METHOD FOR ESTABLISHING COLOR PERFORMANCE DATABASE FOR DISPLAY APPARATUS

This application claims the benefit of Taiwan application Serial No. 103112944, filed Apr. 9, 2014, the subject matter of which is incorporated herein by reference.

BACKGROUND OF THE INVENTION

Field of the Invention

The invention relates in general to a display apparatus, and more particularly to a technology for correcting a display apparatus.

Description of the Related Art

With the flourish of various electronic products, multimedia systems such as home theaters have become popular. One of the most critical hardware devices in most multimedia systems is a display apparatus. Manufacturers or brands of display apparatuses have individual preferences regarding color performances of these display apparatuses, with however a common goal of showcasing brand features or maintaining product consistency. As color performances of each batch of panels may slightly vary due to minute differences in manufacturing processes, manufacturers usually need to test and correct color display settings before shipping a new batch of products out of the factory.

In one conventional approach, a testing staff first selects a bench that satisfies the expected color performance, and measures respective color performances of the bench corresponding to various input signals to accordingly establish a database. Assuming that the grayscale range of the bench is 0 to 255, when 9 grayscale values (0, 31, 63, 95, 127, 159, 191, 223 and 255) of red, green and blue are respectively selected and arranged in different combinations, there are a total of 729 (=9*9*9) grayscale combinations. The testing staff may enter these 729 grayscale combinations into the bench, and respectively measure the CIE XYZ values of an output image of the bench to accordingly generate 729 sets of color performance reference data for the standard database of the bench. Next, the testing staff may sequentially enter multiple red/green/blue grayscale combinations to a display apparatus under test, and measure the CIE XYZ value of an output image of the display apparatus under test to establish a sample database including multiple sets of sample data. From the sample database, the testing staff may then select 729 sets of sample data of color performances respectively most approximate to the 729 sets of reference data to establish a three-dimensional mapping table. For example, assume the CIE XYZ value from the standard database corresponding to a red/green/blue grayscale value (0, 0, 0) is $X_RY_RZ_R$, and the sample data of the CIE XYZ value from the sample database most approximate to $X_RY_RZ_R$ is a red/green/blue grayscale value (3, 7, 0). As such, the red/green/blue grayscale value (3, 7, 0) in the sample data is set to have a mapping relationship with the red/green/blue grayscale value (0, 0, 0) in the reference data. The mapping table is stored to an internal memory of the display apparatus. When the display apparatus under test later receives input data of the red/green/blue grayscale value (0, 0, 0), the display apparatus under test controls its driver circuit to send out the red/green/blue grayscale value (3, 7, 0) according to the above mapping relationship.

It is understandable that, as the number of sample data in the sample database gets larger, there is a greater possibility of finding a set of sample data with a color performance that is more similar to a predetermined set of reference data. For example, by testing all possible red/green/blue grayscale combinations of the display apparatus under test when establishing the sample database, there are a total of 16,777,216 (256*256*256) sets of sample data. However, the measuring task is extremely time consuming, making it almost infeasible to establish such sample database with a colossal data amount. Therefore, the number of sets of sample data available for comparison is usually limited, such that a corrected display apparatus may still fail to achieve the color performance of the bench and to even result in a pointless pre-color correction procedure.

SUMMARY OF THE INVENTION

The invention is directed to a solution for establishing a color performance database. In a correcting method and a correcting apparatus according to the present invention, a part of color performance data in a color performance database of a display apparatus under test is generated through color blending. Compared to the conventional approach of actually measuring the color performance of a predetermined grayscale combination, the solution of calculating the color performance by color blending equations is more time effective. Therefore, without consuming large amounts of human resources and time, a color performance database containing a large amount of sample data can be established to enhance the effects of color correction.

According to an embodiment of the present invention, a correcting method for a display apparatus is provided. For an N number of original grayscale combinations, color performances of the display apparatus are respectively measured to generate an N number of measurement results. According to the N number of measurement results, a set of color blending equations are utilized for an M number of original grayscale combinations to generate an M number of blended results. From the N number of measurement results and the M number of blended results, a P number of color performances respectively most approximate to a P number of target color performances are identified. The P number of target color performances correspond to a P number of target grayscale combinations. The P number of color performances correspond to a P number of original grayscale combinations in the (N+M) number of grayscale combinations. A look-up table (LUT) for correcting the display apparatus is established according to the P number of target grayscale combinations and the P number of corresponding original grayscale combinations.

According to another embodiment of the present invention, a correcting apparatus for a display apparatus is provided. The correcting apparatus includes a measuring module, a color blending module, a searching module and a look-up table (LUT) establishing module. The measuring module measures respective color performances of the display apparatus for an N number of original grayscale combinations to generate an N number of measurement results. The color blending module utilizes a set of color blending equations for an M number of original grayscale combinations to generate an M number of blended results. The searching module identifies a P number of color performances respectively most approximate to a P number of target color performances from a color performance database including the N number of measurement results and the M number of blended results. The P number of target color performances correspond to a P number of target grayscale combinations. The P number of color performances correspond to a P number of original grayscale combinations in the (N+M) number of grayscale combinations. The LUT establishing module established an LUT for correcting the display apparatus according to the P number of target grayscale combinations and the P number of corresponding original grayscale combinations. Wherein, N is an integer greater than 1, M is a positive integer and P is a positive integer.

According to yet another embodiment of the present invention, a method for establishing a color performance database for a display apparatus is provided. For an N number of grayscale combinations, color performances of the display apparatus are respectively measured to generate an N number of measurement results. According to the N number of measurement results, a set of color blending equations are utilized for an M number of grayscale combinations to generate an M number of blended results. Next, the color performance database including the N number of measurement results and the M number of blended results is established.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
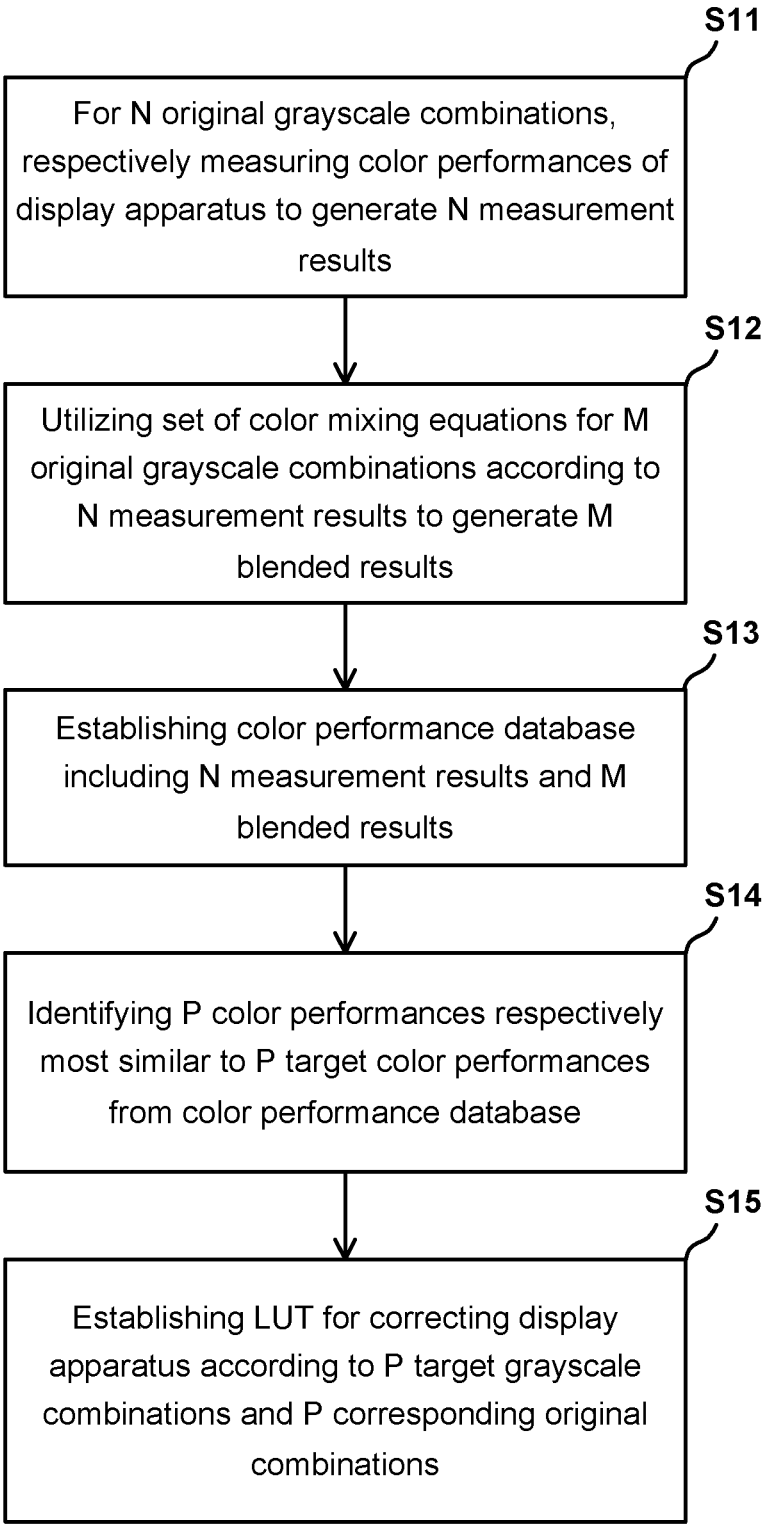
FIG. 1 is a flowchart of a correcting method according to an embodiment of the present invention.

FIG. 1 shows a flowchart of a correcting method for a display apparatus according to an embodiment of the present invention. It should be noted that, the term "present invention" refers to inventive concepts exhibited by the embodiments, with its scope unconfined by these non-limiting embodiments. Further, mathematical expressions in the disclosure are for illustrating principles and logics associated with the embodiments. Unless otherwise specified, these mathematical expressions are not to be construed as limitations to the present invention. One person skilled in the art can understand that there are multiple techniques for implementing physical presentation forms corresponding to these mathematical equations.

Referring to FIG. 1, in step S11, for an N number of original grayscale combinations, color performances of a display apparatus under test are respectively measured to generate an N number of measurement results, where N is a positive integer greater than 1. In one embodiment, assuming that a maximum grayscale value that can be presented by the display apparatus under test is 255, N is set of equal to 766, and 766 grayscale combinations include (0, 0, 1), (0, 0, 2) . . . (0, 0, 255), (0, 1, 0), (0, 2, 0) . . . (0, 255, 0), (1, 0, 0), (2, 0, 0) . . . (255, 0, 0) and (0, 0, 0). Except the grayscale combination (0, 0, 0) corresponding to black, the 766 original grayscale combinations further correspond to 255 levels of red, 255 levels of green and 255 levels of blue with respect to brightness level. Under the above conditions, 766 measurement results are generated in step S11, i.e., 766 mono-color performances of the display apparatus under test are generated. In practice, the measurement results are not limited to a predetermined form, and different color presentation forms may be converted into one another. For example, the N number of measurement results may be CIE XYZ values or CIE Lab values.

In step S12, according to the N number of measurement results generated in step S11, a set of color blending equations are utilized for an M number of original grayscale combinations to generate M number of blended results, where M is a positive integer. In other words, in step S12, color performances of other original grayscale combinations are formed through blending according to the N number of measurement results. In one embodiment, assume that an original grayscale combination in the M number of original grayscale combinations is ($R_O$, $G_O$, $B_O$), and the blended result corresponding to a color combination of red, green and blue is represented by (X',Y',Z'). In one embodiment, the set of color blending equations may be:

$$X'=X(R_O,0,0)+X(0,G_O,0)+X(0,0,B_O),$$

$$Y'=Y(R_O,0,0)+Y(0,G_O,0)+Y(0,0,B_O),$$

$$Z'=Z(R_O,0,0)+Z(0,G_O,0)+Z(0,0,B_O).$$

In the above equations, X($R_O$, 0, 0), Y($R_O$, 0, 0) and Z($R_O$, 0, 0) represent the color performances of the original grayscale combination ($R_O$, 0, 0) in the CIE XYZ color space; X(0, $G_O$, 0), Y(0, $G_O$, 0) and Z(0, $G_O$, 0) represent the color performances of an original grayscale combination (0, $G_O$, 0) in the CIE XYZ color space; and X(0, 0, $B_O$), Y(0, 0, $B_O$) and Z(0, 0, $B_O$) represent the color performances of an original grayscale combination (0, 0, $B_O$) in the CIE XYZ color space. It should be noted that, regardless of the three grayscale values in the grayscale combination ($R_O$, $G_O$, $B_O$), all color performances serving as the calculation basis in the above color blending equations included in the 766 measurement results generated in step S11. For example, if the grayscale combination ($R_O$, $G_O$, $B_O$) of the color performance to be determined is (125, 79, 200), color performances of three grayscale combinations (125, 0, 0), (0, 79, 0) and (0, 0, 200) are utilized in the above color blending equations to generate (X',Y',Z').

If the testing staff intends to have the sample database cover the all color performances of all red/green/blue grayscale combinations that can be presented by the display apparatus under test, i.e., if a sample database including a total number of sample data of 16,777,216 is to be established, the value M in step S12 may be set to 16,777,216−N (e.g., 16,777,216−766=16,776,450). In other words, in addition to the N number of color performances generated through measurement in step S11, all the other possible color performances of the display apparatus under test may be identified through calculation. It should be noted that, M may be another other positive integer or may be determined by the testing staff based on actual requirements. Compared to the conventional measurement of the color performance of each predetermined grayscale combination, the inventive solution of calculation of the color performance by color blending equations is more efficient. It is experimentally proven that, although the blended result (X',Y',Z') calculated by the above color blending equations may slightly deviate from the actual color performance corresponding to the grayscale ($R_O$, $G_O$, $B_O$) of the display apparatus under test, the two values are in fact quite similar.

In another embodiment, the value N in step S11 is set to equal to 1,021, and the 1,020 original grayscale combinations include (0, 0, 1), (0, 0, 2) . . . (0, 0, 255), (0, 1, 0), (0, 2, 0) . . . (0, 255, 0), (1, 0, 0), (2, 0, 0) . . . (255, 0, 0), (0, 0, 0), (1, 1, 1) . . . (255, 255, 255). In addition to 255 levels of red, 255 levels of green and 255 levels of blue arranged in an increasing brightness level, the 1,021 original grayscale combinations further correspond to 256 levels of gray (gray in 256 different brightness levels, with the darkest being black and the lightest being white). Under the above situations, the set of color blending equations adopted in step S12 may be:

$$X' = X_R + X_G + X_B,$$

$$Y' = Y_R + Y_G + Y_B,$$

$$Z' = Z_R + Z_G + Z_B,$$

$$X_R = X(R_O, 0, 0) \times \frac{X(R_O, R_O, R_O)}{X(R_O, 0, 0) + X(0, R_O, 0) + X(0, 0, R_O)},$$

$$X_G = X(0, G_O, 0) \times \frac{X(G_O, G_O, G_O)}{X(G_O, 0, 0) + X(0, G_O, 0) + X(0, 0, G_O)},$$

$$X_B = X(0, 0, B_O) \times \frac{X(B_O, B_O, B_O)}{X(B_O, 0, 0) + X(0, B_O, 0) + X(0, 0, B_O)},$$

$$Y_R = Y(R_O, 0, 0) \times \frac{Y(R_O, R_O, R_O)}{Y(R_O, 0, 0) + Y(0, R_O, 0) + Y(0, 0, R_O)},$$

$$Y_G = Y(0, G_O, 0) \times \frac{Y(G_O, G_O, G_O)}{Y(G_O, 0, 0) + Y(0, G_O, 0) + Y(0, 0, G_O)},$$

$$Y_B = Y(0, 0, B_O) \times \frac{Y(B_O, B_O, B_O)}{Y(B_O, 0, 0) + Y(0, B_O, 0) + Y(0, 0, B_O)},$$

$$Z_R = Z(R_O, 0, 0) \times \frac{Z(R_O, R_O, R_O)}{Z(R_O, 0, 0) + Z(0, R_O, 0) + Z(0, 0, R_O)},$$

$$Z_G = Z(0, G_O, 0) \times \frac{Z(G_O, G_O, G_O)}{Z(G_O, 0, 0) + Z(0, G_O, 0) + Z(0, 0, G_O)},$$

$$Z_B = Z(0, 0, B_O) \times \frac{Z(B_O, B_O, B_O)}{Z(B_O, 0, 0) + Z(0, B_O, 0) + Z(0, 0, B_O)}.$$

In the above equations, $X(R_O, 0, 0)$, $Y(R_O, 0, 0)$ and $Z(R_O, 0, 0)$ represent the color performances of the original grayscale combination $(R_O, 0, 0)$ in the CIE XYZ color space; $X(0, G_O, 0)$, $Y(0, G_O, 0)$ and $Z(0, G_O, 0)$ represent the color performances of the original grayscale combination $(0, G_O, 0)$ in the CIE XYZ color space; $X(0, 0, B_O)$, $Y(0, 0, B_O)$ and $Z(0, 0, B_O)$ represent the color performances of the original grayscale combination $(0, 0, B_O)$ in the CIE XYZ color space; $X(R_O, R_O, R_O)$, $Y(R_O, R_O, R_O)$ and $Z(R_O, R_O, R_O)$ represent the color performances of the original grayscale combination $(R_O, R_O, R_O)$ in the CIE XYZ color space; $X(G_O, G_O, G_O)$, $Y(G_O, G_O, G_O)$ and $Z(G_O, G_O, G_O)$ represent the color performances of the original grayscale combination $(G_O, G_O, G_O)$ in the CIE XYZ color space; $X(B_O, B_O, B_O)$, $Y(B_O, B_O, B_O)$ and $Z(B_O, B_O, B_O)$ represent the color performances of the original grayscale combination $(B_O, B_O, B_O)$ in the CIE XYZ color space; $X(0, R_O, 0)$, $Y(0, R_O, 0)$ and $Z(0, R_O, 0)$ represent the color performances of the original grayscale combination $(0, R_O, 0)$ in the CIE XYZ color space; $X(0, 0, R_O)$, $Y(0, 0, R_O)$ and $Z(0, 0, R_O)$ represent the color performances of the original grayscale combination $(0, 0, R_O)$ in the CIE XYZ color space; $X(G_O, 0, 0)$, $Y(G_O, 0, 0)$ and $Z(G_O, 0, 0)$ represent the color performances of the original grayscale combination $(G_O, 0, 0)$ in the CIE XYZ color space; $X(0, 0, G_O)$, $Y(0, 0, G_O)$ and $Z(0, 0, G_O)$ represent the color performances of the original grayscale combination $(0, 0, G_O)$ in the CIE XYZ color space; $X(B_O, 0, 0)$, $Y(B_O, 0, 0)$ and $Z(B_O, 0, 0)$ represent the color performances of the original grayscale combination $(B_O, 0, 0)$ in the CIE XYZ color space; and $X(0,B_O, 0)$, $Y(0,B_O, 0)$ and $Z(0,B_O, 0)$ represent the color performances of the original grayscale combination $(0,B_O, 0)$ in the CIE XYZ color space.

A main difference between the two foregoing sets of color blending equations is that, the blended result obtained from the second set of color blending equations is more similar to the actual color performance and however involves a more complicated calculation procedure. Similarly, regardless of the three grayscale values in the grayscale combination $(R_O, G_O, B_O)$, all color performances serving as the calculation basis in the above color blending equations are included in the 1,021 measurement results generated in step S11. For example, if the grayscale combination $(R_O, G_O, B_O)$ of the color performance to be determined is (125, 79, 200), color performances of 12 grayscale combinations (125, 0, 0), (0, 125, 0), (0, 0, 125), (125, 125, 125), (79, 0, 0), (0, 79, 0), (0, 0, 79), (79, 79, 79), (200, 0, 0), (0, 200, 0), (0, 0, 200) and (200, 200, 200) are utilized by the above color blending equations to obtain (X',Y',Z'). Correspondingly, when the value N is equal to 1,021, the value M may be designed as 16,776,195 (=16,777,216−1,021).

In step S13, a color performance database including the N number of measurement results and the M number of blended results is established. That is, the (N+M) number of color performances corresponding to the (N+M) grayscale combinations of the display apparatus under test are sorted.

In step S14, from the color performance database established in step S13, a P number of color performances respectively most approximate to a P number of target color performances are identified, where P is a positive integer. In other words, in step S14, the P number of color performances respectively most approximate to the P number of target color performances are identified from the (N+M) number of color performances of the display apparatus under test. The P number of target color performances correspond to the P number of grayscale combinations, and are color performances that the testing staff intends to achieve after the display apparatus under test is corrected. In practice, the P number of target color performances are known information before step S14 is performed. For example, the value P may be equal to 729, and the 729 target color performances are the CIE XYZ values that the bench obtains from measuring corresponding 729 grayscale combinations.

In practice, for a predetermined target color performance, an iteration equation may be utilized to identify respective differences between the (N+M) color performances and the target color performance to further identify the color performance having the smallest difference. Generally known to one person skilled in the art, there are various ways for determining differences between two color performances. For example, a difference ΔE between a first color performance $(X_1, Y_1, Z_1)$ and a second color performance $(X_2, Y_2, Z_2)$ in the CIE XYZ color space is evaluated according to an equation below:

$$\Delta E = \sqrt{(X_1 - X_2)^2 + (Y_1 - Y_2)^2 + (Z_1 - Z_2)^2}$$

Alternatively, the difference ΔE between a first color performance $(L_1, a_1, b_1)$ and a second color performance $(L_2, a_2, b_2)$ in the CIE Lab color space is evaluated according to an equation below:

$$\Delta E = \sqrt{(L_1 - L_2)^2 + (a_1 - a_2)^2 + (b_1 - b_2)^2}$$

As previously described, the number of sample data in the color performance database of the present invention is associated with the values N and M, and is not limited to a predetermined number. In practice, (N+M) is preferably designed to be more than 8 times of P. Thus, an average value of differences between the P number of color performances identified from the color performance database and the P number of target color performances may be reduced, so as to further achieve an effect of duplicating the color performances of the bench to the display apparatus under test.

It is obvious that the P number of color performances correspond to the P number of original grayscale combinations in the (N+M) original grayscale combinations. In step S15, a look-up table (LUT) for correcting the display apparatus is established according to the P number of target grayscale combinations and the P number of corresponding original grayscale combinations. The LUT may be regarded as stored with a P number of mapping relationships. It should be noted that, steps S11 to S15 are usually performed before the display apparatus is shipped out of the factory, and the LUT established in step S15 is primarily applied in a correction procedure after the display apparatus is shipped out of the factory. For example, in a common operation mode in which a user view images, for a predetermined grayscale combination in an input signal, the display apparatus may identify a target grayscale combination identical or most approximate to the inputted grayscale combination from the above LUT by using the inputted grayscale combination as an index, and control its driver circuit to send out an original grayscale combination corresponding to the target grayscale combination.

In practice, when the inputted grayscale combination is between a plurality of target grayscale combinations, i.e., when the inputted grayscale combination is simultaneously similar to a plurality of target grayscale combinations, the display apparatus may also simultaneously identify a plurality of original grayscale combinations corresponding to a plurality of target grayscale combinations, and generate a new grayscale combination through interpolation according to the plurality of original grayscale combinations.

Figure 2:
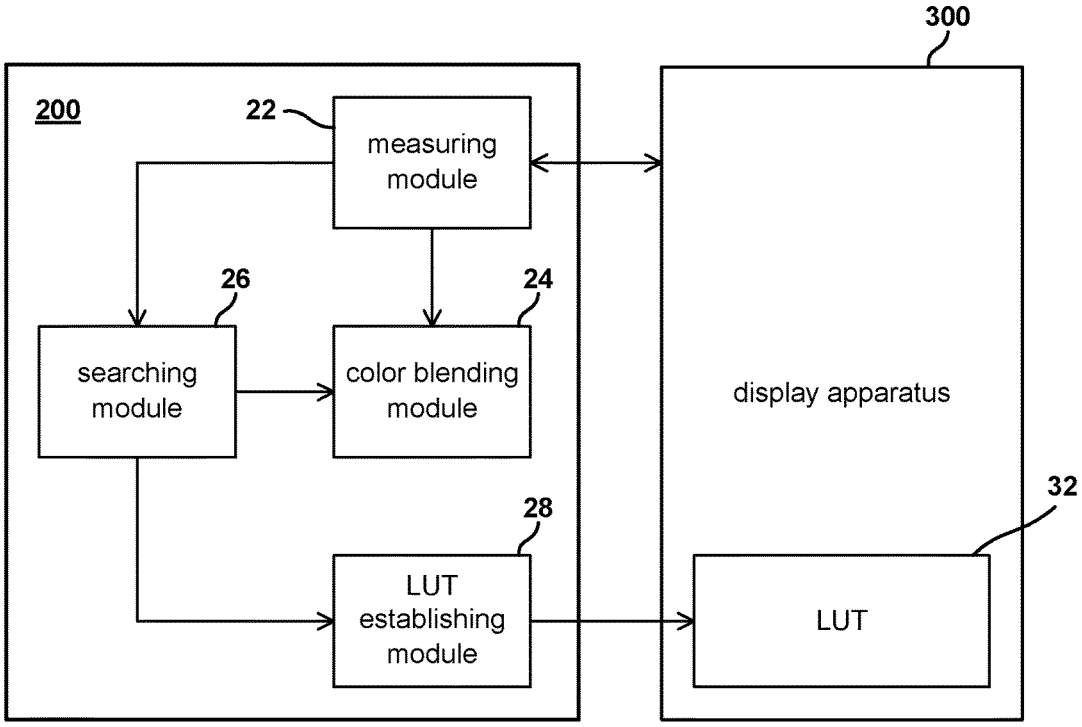
FIG. 2 is a function block diagram of a correcting apparatus according to an embodiment of the present invention.

FIG. 2 shows a function block diagram of a correcting apparatus for a display apparatus according to an embodiment of the present invention. A correcting apparatus 200 includes a measuring module 22, a color blending module 24, a searching module 26 and an LUT establishing module 28. For an N number of original grayscale combinations, the measuring module 22 measures color performances of a display apparatus 300 to generate an N number of measurement results. The color blending module 24 utilizes a set of color blending equations for an M number of original grayscale combinations according to the N number of measurement results to generate an M number of blended results. From a color performance database including the N number of measurement results and the M number of blended results, the searching module 26 identifies a P number of color performances respectively most approximate to a P number of target color performances. The P number of target color performances correspond to a P number of target grayscale combinations. The P number of color performances correspond to a P number of original grayscale combinations from the (N+M) original grayscale combinations. The LUT establishing module 28 establishes an LUT 32 for correcting the display apparatus 300 according to the P number of target grayscale combinations and the P number of corresponding original grayscale combinations. Wherein, N is an integer greater than 1, M is a positive integer and P is a positive integer.

In practice, the LUT 32 may be stored in a built-in memory of the display apparatus 300. Various operation details and modifications (e.g., different color blending equations) in the description associated with the correcting method in FIG. 1 are applicable to the correcting apparatus 200, and shall be omitted herein.

According to another embodiment of the present invention, a method for establishing a color performance database for a display apparatus is provided. First of all, for an N number of grayscale combinations, color performances of the display apparatus are respectively measured to generate an N number of measurement results. According to the N number of measurement results, a set of color blending equations are utilized for an M number of grayscale combinations to generate an M number of blended results. Next, the color performance database including the N number of measurement results and the M number of blended results is established. In other words, the color performance database of the present invention may be applied to a situation other than establishing a correction LUT.

As described, the present invention provides a solution for establishing a color performance database. In the correcting method and the correcting apparatus of the present invention, a part of the color performance data in the color performance database is generated through color blending. Compared to the conventional approach of actually measuring the color performance of a predetermined grayscale combination, the solution of calculating the color performance by color blending equations is more time effective. Therefore, without consuming large amounts of labor and time costs, a color performance database containing a large amount of sample data (to cover even all color performances of the display apparatus) can be established to enhance the effects of color correction.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A correcting method for a display apparatus, implemented in a non-transitory computer readable medium, comprising:

a) measuring respective color performances of the display apparatus for N original grayscale combinations, to generate N measurement results, where N is a positive integer greater than 1;

b) utilizing a set of color blending equations for M original grayscale combinations according to the N measurement results to generate M blended results, where M is a positive integer;

c) establishing a color performance database comprising (N+M) color performances according to the N measurement results and the M blended results;

d) identifying P color performances respectively most approximate to a P predetermined target color performances from the color performance database, wherein P is a positive integer; wherein, the P target color performances correspond to P target grayscale combinations, and the identified P color performances correspond to P original grayscale combinations in the (N+M) original grayscale combinations; and e) establishing a look-up table (LUT) according to the P target grayscale and the corresponding P original grayscale combinations; and f) controlling a driver circuit of the display apparatus to send out an original grayscale combination corresponding to a target grayscale combination determined using the LUT with an inputted grayscale combination as an index, wherein a maximum grayscale value that the display apparatus supports is $G_{MAX}$, and the N original grayscale combinations comprises (0, 0, 1), (0, 0, 2) . . . (0, 0, $G_{MAX}$), (0, 1, 0), (0, 2, 0) . . . (0, $G_{MAX}$, 0), (1, 0, 0), (2, 0, 0) . . . ($G_{MAX}$, 0, 0) and (0, 0, 0), wherein one of the M original grayscale combinations is ($R_0$, $G_0$, $B_0$), the blended result is (X',Y',Z'), and the set of color blending equations comprises:

$$X'=X(R_0,0,0)+X(0,G_0,0)+X(0,0,B_0),$$

$$Y'=Y(R_0,0,0)+Y(0,G_0,0)+Y(0,0,B_0),$$

$$Z'=Z(R_0,0,0)+Z(0,G_0,0)+Z(0,0,B_0),$$

wherein, $X(R_0,0,0)$, $Y(R_0,0,0)$ and $Z(R_0,0,0)$ represent the color performances of an original grayscale combination ($R_0$,0,0) in a CIE XYZ color space; X(0, $G_0$,0), Y(0,$G_0$,0) and Z(0,$G_0$,0) represent the color performances of an original grayscale combination (0,$G_0$,0) in the CIE XYZ color space; and X(0,0,$B_0$), Y(0,0,$B_0$) and Z(0,0,$B_0$) represent the color performances of an original grayscale combination (0,0, $B_0$) in the CIE XYZ color space.

2. The correcting method according to claim 1, wherein a maximum grayscale value that the display apparatus supports is $G_{MAX}$, and the N original Grayscale combinations comprises (0, 0, 1), (0, 0, 2) . . . (0, 0, $G_{mAx}$), (0, 1, 0), (0, 2, 0) . . . (0, $G_{MAX}$, 0), (1, 0, 0), (2, 0, 0) . . . ($G_{MAX}$, 0, 0), (0, 0, 0), (1, 1, 1) . . . ($G_{MAX}$, $G_{MAX}$, $G_{MAX}$).

3. The correcting method according to claim 2, wherein a one of the M original grayscale is ($R_0$,$G_0$,$B_0$); the blended result is (X',Y',Z'); the measurement result X' is generated according to X($R_0$,0,0), X(0,$R_0$,0), X(0,0,$R_0$), X($R_0$,$R_0$,$R_0$), X(0,$G_0$,0), X($G_0$,0,0), X(0,0,$G_0$), X($G_0$,$G_0$,$G_0$), X(0,0,$B_0$), X($B_0$,0,0), X(0,$B_0$,0) and X($B_0$,$B_0$,$B_0$); the measurement result Y' is generated according to Y($R_0$,0,0), Y(0,$R_0$,0), Y(0,0,$R_0$), Y($R_0$,$R_0$,$R_0$), Y(0,$G_0$,0), Y($G_0$,0,0), Y(0,0,$G_0$), Y($G_0$,$G_0$,$G_0$), Y(0,0,$B_0$), Y($B_0$,0,0), Y(0,$B_0$,0) and Y($B_0$,$B_0$, $B_0$); the measurement result Z' is generated according to Z($R_0$,0,0), Z(0,$R_0$,0), Z(0,0,$R_0$), Z($R_0$,$R_0$,$R_0$), Z(0,$G_0$,0), Z($G_0$,0,0), Z(0,0,$G_0$), Z($G_0$,$G_0$,$G_0$), Z(0,0,$B_0$), Z($B_0$,0,0), Z(0,$B_0$,0) and Z($B_0$,$B_0$,$B_0$); X($R_0$,0,0), Y($R_0$,0,0) and Z($R_0$, 0,0) represent the color performances of an original grayscale combination ($R_0$,0,0) in the CIE XYZ color space; X(0,$G_0$,0), Y(0,$G_0$,0) and Z(0,$G_0$,0) represent the color performances of an original grayscale combination (0,$G_0$,0) in the CIE XYZ color space; X(0,0,$B_0$), Y(0,0,$B_0$) and Z(0,0,$B_0$) represent the color performances of an original grayscale combination (0,0,$B_0$) in the CIE XYZ color space; X($R_0$,$R_0$,$R_0$), Y($R_0$,$R_0$,$R_0$) and Z($R_0$,$R_0$,$R_0$) represent the color performances of an original grayscale combination ($R_0$,$R_0$,$R_0$) in the CIE XYZ color space; X($G_0$,$G_0$,$G_0$), Y($G_0$,$G_0$,$G_0$) and Z($G_0$,$G_0$,$G_0$) represent the color performances of an original grayscale combination ($G_0$,$G_0$,$G_0$) in the CIE XYZ color space; X($B_0$,$B_0$,$B_0$), Y($B_0$,$B_0$,$B_0$) and Z($B_0$,$B_0$,$B_0$) represent the color performances of an original grayscale combination ($B_0$,$B_0$,$B_0$) in the CIE XYZ color space; X(0,$R_0$,0), Y(0,$R_0$,0) and Z(0,$R_0$,0) represent the color performances of an original grayscale combination (0,$R_0$,0) in the CIE XYZ color space; X(0,0,$R_0$), Y(0,0,$R_0$) and Z(0,0,$R_0$) represent the color performances of an original grayscale combination (0,0,$R_0$) in the CIE XYZ color space; X($G_0$,0,0), Y($G_0$,0,0) and Z($G_0$,0,0) represent the color performances of an original grayscale combination ($G_0$,0,0) in the CIE XYZ color space; X(0,0,$G_0$), Y(0,0,$G_0$) and Z(0,0,$G_0$) represent the color performances of an original grayscale combination (0,0,$G_0$) in the CIE XYZ color space; X($B_0$,0,0), Y($B_0$,0,0) and Z($B_0$,0,0) represent the color performances of an original grayscale combination ($B_0$,0,0) in the CIE XYZ color space; and X(0,$B_0$,0), Y(0, $B_0$,0) and Z(0,$B_0$,0) represent the color performances of an original grayscale combination (0,$B_0$,0) in the CIE XYZ color space.

4. The correcting method according to claim 3, wherein the set of color blending equations comprise:

$$X' = X_R + X_G + X_B,$$

$$Y' = Y_R + Y_G + Y_B,$$

$$Z' = Z_R + Z_G + Z_B,$$

$$X_R = X(R_O, 0, 0) \times \frac{X(R_O, R_O, R_O)}{X(R_O, 0, 0) + X(0, R_O, 0) + X(0, 0, R_O)},$$

$$X_G = X(0, G_O, 0) \times \frac{X(G_O, G_O, G_O)}{X(G_O, 0, 0) + X(0, G_O, 0) + X(0, 0, G_O)},$$

$$X_B = X(0, 0, B_O) \times \frac{X(B_O, B_O, B_O)}{X(B_O, 0, 0) + X(0, B_O, 0) + X(0, 0, B_O)},$$

$$Y_R = Y(R_O, 0, 0) \times \frac{Y(R_O, R_O, R_O)}{Y(R_O, 0, 0) + Y(0, R_O, 0) + Y(0, 0, R_O)},$$

$$Y_G = Y(0, G_O, 0) \times \frac{Y(G_O, G_O, G_O)}{Y(G_O, 0, 0) + Y(0, G_O, 0) + Y(0, 0, G_O)},$$

$$Y_B = Y(0, 0, B_O) \times \frac{Y(B_O, B_O, B_O)}{Y(B_O, 0, 0) + Y(0, B_O, 0) + Y(0, 0, B_O)},$$

$$Z_R = Z(R_O, 0, 0) \times \frac{Z(R_O, R_O, R_O)}{Z(R_O, 0, 0) + Z(0, R_O, 0) + Z(0, 0, R_O)},$$

$$Z_G = Z(0, G_O, 0) \times \frac{Z(G_O, G_O, G_O)}{Z(G_O, 0, 0) + Z(0, G_O, 0) + Z(0, 0, G_O)}, \text{ and}$$

$$Z_B = Z(0, 0, B_O) \times \frac{Z(B_O, B_O, B_O)}{Z(B_O, 0, 0) + Z(0, B_O, 0) + Z(0, 0, B_O)}.$$

5. The correcting method according to claim 1, wherein step (d) comprises evaluating a difference ΔE between a first color performance ($X_1$,$Y_1$,$Z_1$) and a second color performance ($X_2$,$Y_2$,$Z_2$) in the CIE XYZ color space according to an equation:

$$\Delta E=\sqrt{((X_1-X_2)2+(Y_1-Y_2)2+(Z_1-Z_2)2)}.$$

6. The correcting method according to claim 1, wherein step (d) comprises evaluating a difference ΔE between a first color performance ($L_1$,$a_1$,$b_1$) and a second color performance ($L_2$,$a_2$,$b_2$) in a CIE Lab color space according to an equation:

$$\Delta E=\sqrt{((L_1-L_2)2+(a_1-a_2)2+(b_1-b_2)2)}.$$

7. A method for establishing a color performance database for a display apparatus, implemented in a non-transitory computer readable medium, comprising:

a) for N grayscale combinations, measuring respective color performances of the display apparatus to generate N measurement results, where N is a positive integer greater than 1;

b) utilizing a set of color blending equations for M grayscale combinations according to the N measurement results to generate M blended result, where M is a positive integer; and c) establishing a color performance database comprising (N+M) color performances according to the N measurement results and the M blended results, wherein a maximum grayscale value that the display apparatus supports is $G_{MAX}$, and the N grayscale combinations comprises (0, 0, 1), (0, 0, 2) . . . (0, 0,$G_{MAX}$), (0, 1, 0), (0, 2, 0) . . . (0, $G_{MAX}$, 0), (1, 0, 0), (2, 0, 0) . . . ($G_{MAX}$,0,0) and (0, 0, 0), wherein one of the M grayscale combinations is ($R_0$,$G_0$, $B_0$), the blended result is (X',Y',Z'), and the set of color blending equations comprises:

$$X'=X(R_0,0,0)+X(0,G_0,0)+X(0,0,B_0)$$

$$Y'=Y(R_0,0,0)+Y(0,G_0,0)+Y(0,0,B_0)$$

$$Z'=Z(R_0,0,0)+Z(0,G_0,0)+Z(0,0,B_0)$$

wherein, X($R_0$,0,0), Y($R_0$,0,0) and Z($R_0$,0,0) represent the color performances of a grayscale combination ($R_0$,0,0) in a CIE XYZ color space; X(0,$G_0$,0), Y(0,$G_0$,0) and Z(0,$G_0$,0) represent the color performances of a grayscale combination (0, $G_0$,0) in the CIE XYZ color space; and X(0,0,$B_0$), Y(0,0,$B_0$) and Z(0,0,$B_0$) represent the color performances of a grayscale (0,0,$B_0$) in the CIE XYZ color space.

8. The method according to claim 7, wherein a maximum grayscale value that the display apparatus supports is $G_{MAX}$, and the N grayscale combinations comprises (0, 0, 1), (0, 0, 2) . . . (0, 0, $G_{MAX}$), (0, 1, 0), (0, 2, 0) . . . (0, $G_{MAX}$, 0), (1, 0, 0), (2, 0, 0) . . . ($G_{MAX}$, 0, 0), (0, 0, 0), (1, 1, 1) . . . ($G_{MAX}$, $G_{MAX}$, $G_{MAX}$).

* * * * *